US007845503B2

(12) United States Patent
Laurini

(10) Patent No.: US 7,845,503 B2
(45) Date of Patent: Dec. 7, 2010

(54) PIPE-LAYING MACHINE

(75) Inventor: Marco Laurini, Busseto (IT)

(73) Assignee: Laurini Officine Meccaniche S.R.L., Busseto (IT)

( * ) Notice: Subject to any disclaimer, the term of this patent is extended or adjusted under 35 U.S.C. 154(b) by 22 days.

(21) Appl. No.: 12/373,095

(22) PCT Filed: May 2, 2007

(86) PCT No.: PCT/IB2007/001135

§ 371 (c)(1),
(2), (4) Date: Jan. 9, 2009

(87) PCT Pub. No.: WO2008/010033

PCT Pub. Date: Jan. 24, 2008

(65) Prior Publication Data

US 2010/0000954 A1 Jan. 7, 2010

(30) Foreign Application Priority Data

Jul. 12, 2006 (IT) ..... PC2006A0029

(51) Int. Cl.
*B66C 23/76* (2006.01)

(52) U.S. Cl. ..... 212/197; 212/258; 212/276

(58) Field of Classification Search ..... 212/197–198, 212/258, 279
See application file for complete search history.

(56) References Cited

U.S. PATENT DOCUMENTS

| | | | | |
|---|---|---|---|---|
| 1,139,915 | A * | 5/1915 | Smulders | 212/197 |
| 1,497,686 | A * | 6/1924 | Johnson | 212/197 |
| 1,718,434 | A * | 6/1929 | Ronk | 212/170 |
| 2,674,378 | A * | 4/1954 | Meyer et al. | 212/178 |
| 3,029,088 | A * | 4/1962 | Loef | 280/62 |
| 3,814,265 | A * | 6/1974 | Miller | 212/276 |
| 4,083,459 | A | 4/1978 | Allen | |
| 4,132,317 | A | 1/1979 | Arendt et al. | |
| 4,817,746 | A | 4/1989 | Purcell et al. | |
| 5,031,973 | A | 7/1991 | Gillet | |
| 5,332,110 | A | 7/1994 | Forsyth | |
| 6,893,189 | B2 * | 5/2005 | Matsushita et al. | 405/155 |
| 2001/0009241 | A1 | 7/2001 | Haringer | |
| 2003/0226697 | A1 | 12/2003 | Haringer | |

FOREIGN PATENT DOCUMENTS

| | | |
|---|---|---|
| EP | 0 362 062 | 4/1990 |
| EP | 1 362 773 | 11/2003 |
| NL | 8 102 087 | 9/1981 |

* cited by examiner

OTHER PUBLICATIONS

International Search Report dated Nov. 30, 2007, from corresponding PCT application.

*Primary Examiner*—Thomas J Brahan
(74) *Attorney, Agent, or Firm*—Young & Thompson

(57) ABSTRACT

A pipe-laying machine includes a self-propelled tracked vehicle, on one side of which is fitted a crane designed for lifting and laying pipes. The machine is also fitted with a counterweight constituted by a plate made of a heavy material that moves between a rest position in which it retracts fully into the vehicle and an operational position in which it projects from the vehicle on the opposite side to the crane. In the machine according to the invention, engine unit and control cab are located at each end of chassis, projecting slightly from it, to leave a free space in the central part of the vehicle for the installation of all the mechanisms designed for the movement and control of the crane.

15 Claims, 5 Drawing Sheets

PIPE-LAYING MACHINE

This invention relates to a perfected pipe-laying machine.

In particular, it relates to a pipe-laying machine consisting of a tracked vehicle to which is removably fitted a crane boom able to lift pipes and the like and lay them at the bottom of a trench.

The characteristic feature of this invention is that it includes the counterweight required to balance the moment created by the crane when it operates in the projecting configuration. Said counterweight consists of a very thick metal (e.g. iron) plate, which is positioned between the tracks of the vehicle and is subject to the action of means that allow it to be moved from a rest position in which it retracts fully into the machine and an operational position in which it projects from the machine to counterbalance the effect of the loads lifted by the crane.

In the machine according to the invention, the engine unit and control cab are located at each end of the chassis, slightly projecting from it, to leave a free space in the central part of the vehicle where all the crane movement and control mechanisms can be installed.

Underground pipes, such as gas and oil pipelines, consist of relatively large, heavy pipe sections, and special machines called pipe-laying machines are used to lay them.

Said pipe-laying machines, which generally derive from other machines, such as bulldozers or other common earth-moving machinery, suitably modified, comprise a tracked chassis driven by an internal combustion engine, to which a crane designed for lifting and moving the pipes is fitted laterally.

The engine is positioned in the central part of the chassis, behind the cab, and the crane boom is hinged to the crawler track carriage.

This configuration, derived from other machines, restricts the operator's view, which is partly limited by the presence of the engine, and tends to cause a certain imbalance of the machine, which must be compensated by counterweights. Said counterweights are generally installed, in a projecting configuration, on an articulated structure positioned on the opposite side of the machine to the crane.

When heavy loads are lifted in a projecting configuration, they are subject to high moments which tend to tilt them from the side where the pipes are lifted. Moreover, as the engine unit and the cab are positioned well above ground level, the centre of gravity of the machine is rather high, with adverse effects on its stability.

To overcome this drawback, in addition to using large vehicles which, having a considerable mass, are less subject to the unbalancing effects of the loads lifted, suitable counterweights must be installed on the opposite side of the machine to the crane.

However, this results in a further drawback, as these machines are so large that they cannot be transported by road with normal vehicles; abnormal load transport with an escort is required, making the operation more onerous in financial and organisational terms.

To eliminate these problems, this invention offers a perfected pipe-laying machine comprising a tracked chassis to which is fitted a boom designed to lift and lay pipes and the like, which said machine is fitted with a counterweight consisting of a very thick plate made of metal, such as iron, positioned at the same height as the crawler tracks. In particular, said counterweight is installed in a seating in the tracked chassis, on the opposite side of the machine to the side from which the crane projects, and is subject to the action of means which allow it to be moved from an operational position in which it projects from the machine to a rest position in which it retracts fully into the vehicle. in which it retracts fully into the vehicle.

This system allows the moment created by the loads lifted to be counterbalanced on the opposite side of the machine, thus eliminating the risk of overturning, while keeping the size of the machine within the limits which allow it to be transported by road without the use of special vehicles and/or transport.

Moreover, the engine unit and the cab are located at either end of the chassis. In this way a free space is left in the central part for the installation of the winches and other crane control elements, thus keeping the width of the machine within the limits which allow its transport with no need for special vehicles.

This solution also allows better visibility, during both manoeuvres and pipe movement operations, because the operator has a completely free view on three sides.

This invention also offers an improved system for coupling the boom to the machine, which reduces the width of the machine when the crane boom is removed for road transport purposes.

This invention will now be described in detail, by way of example but not of limitation, by reference to the annexed figures wherein.

Figure 1:
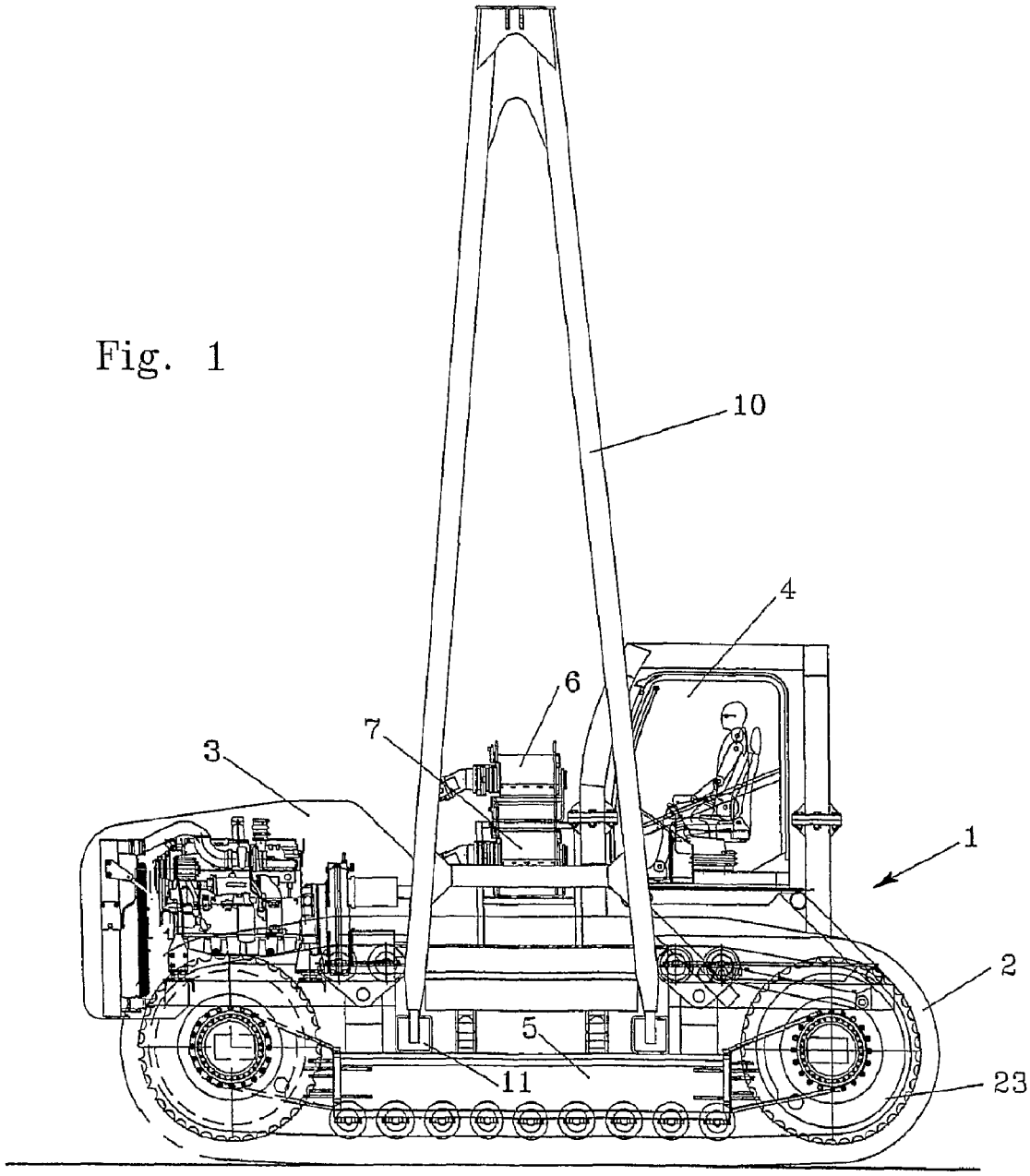
FIG. 1 is a side view of the perfected pipe-laying machine, in the version with rear cab.
Figure 2:
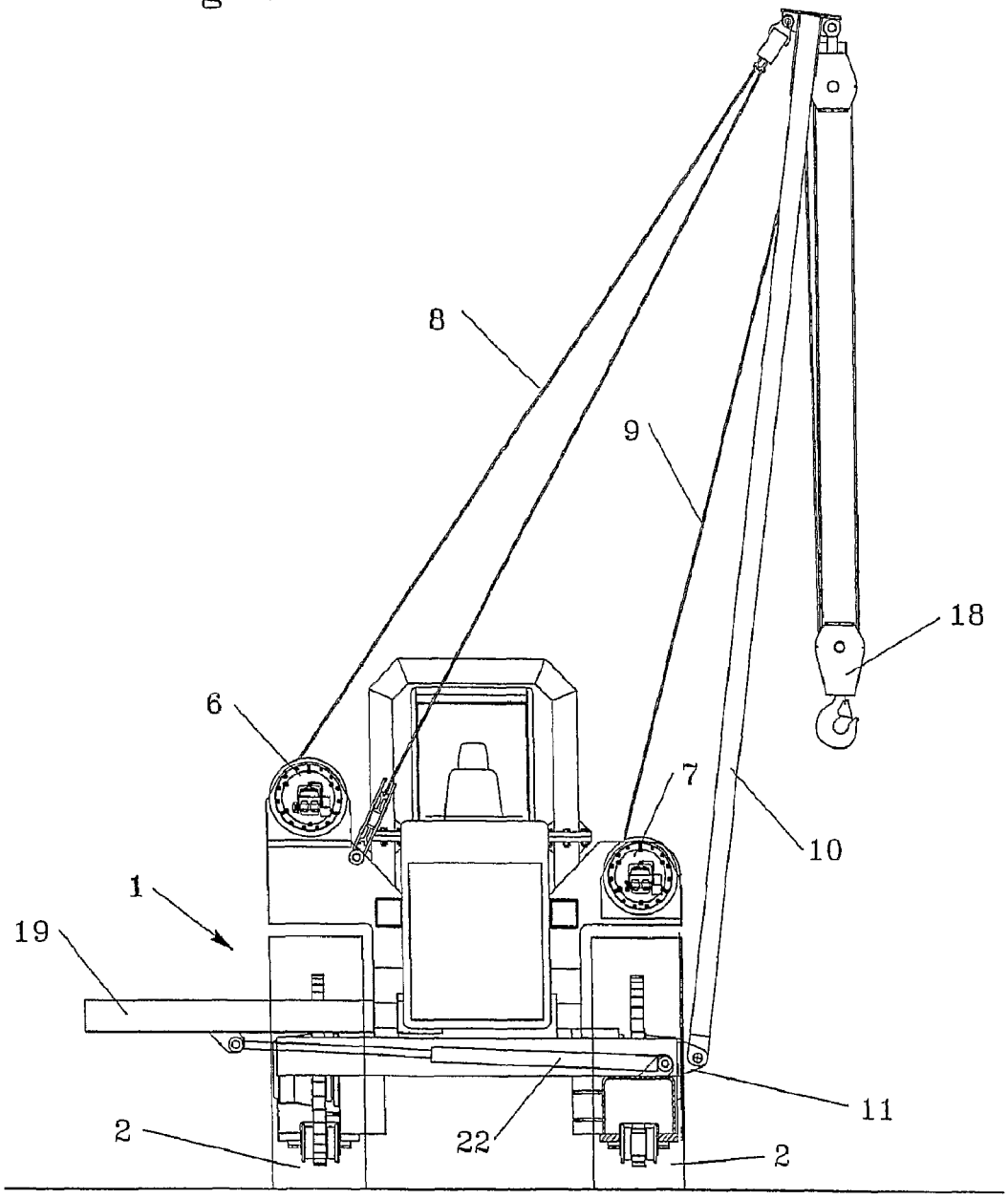
FIG. 2 is a front view of the perfected pipe-laying machine, in the version with rear cab.
Figure 2A:
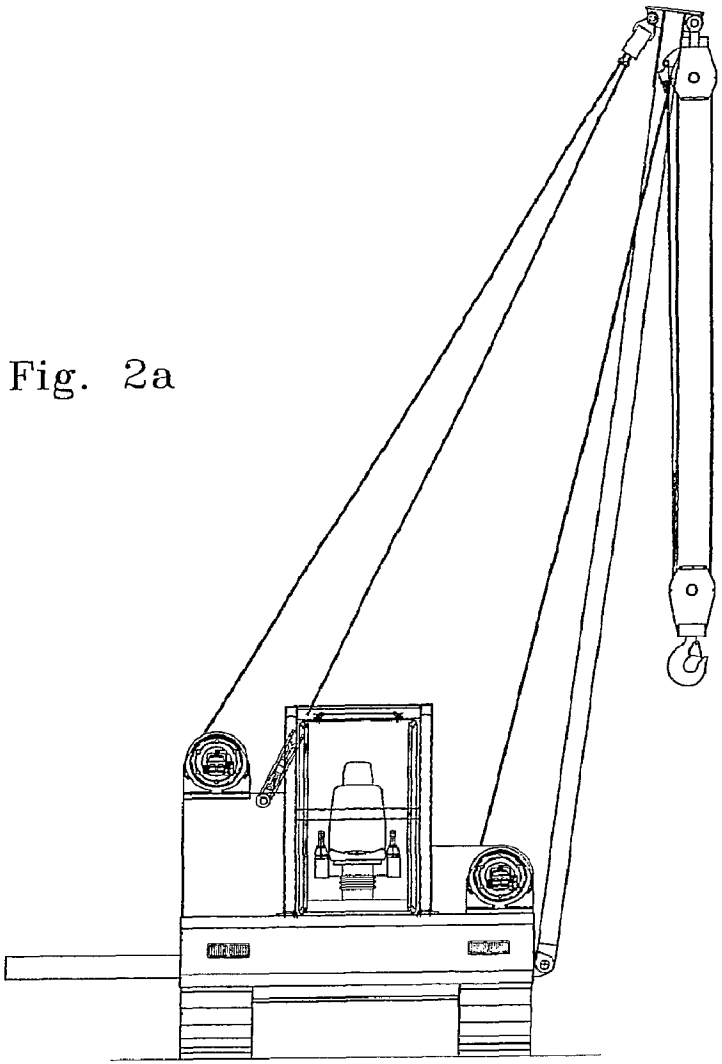
Figure 1A:
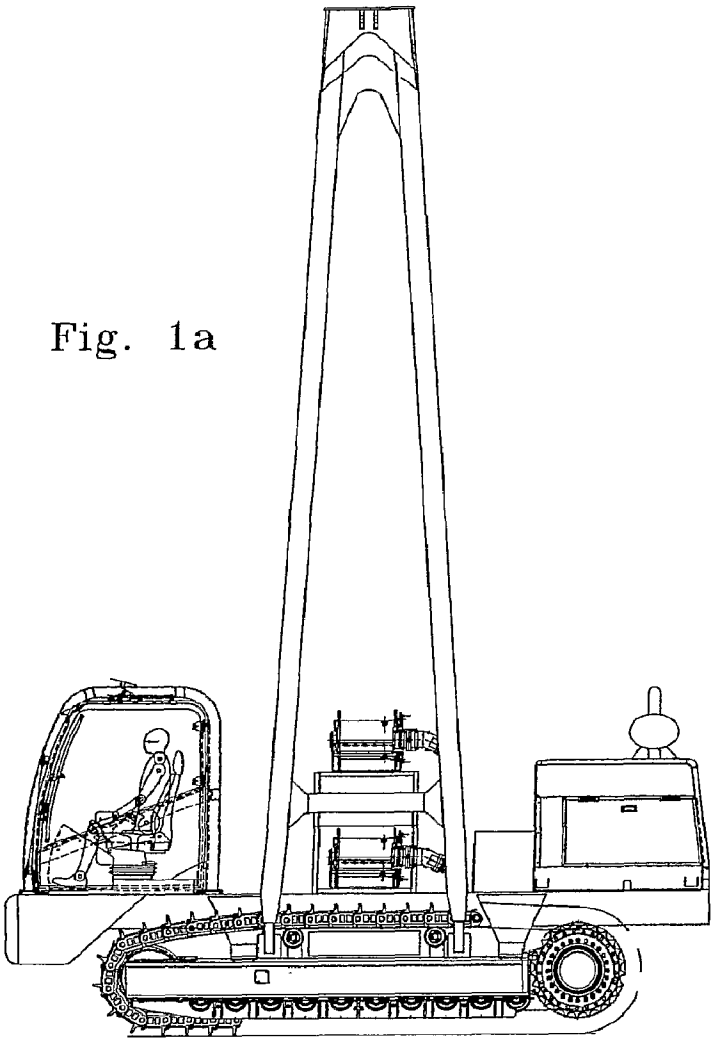
Figure 4A:
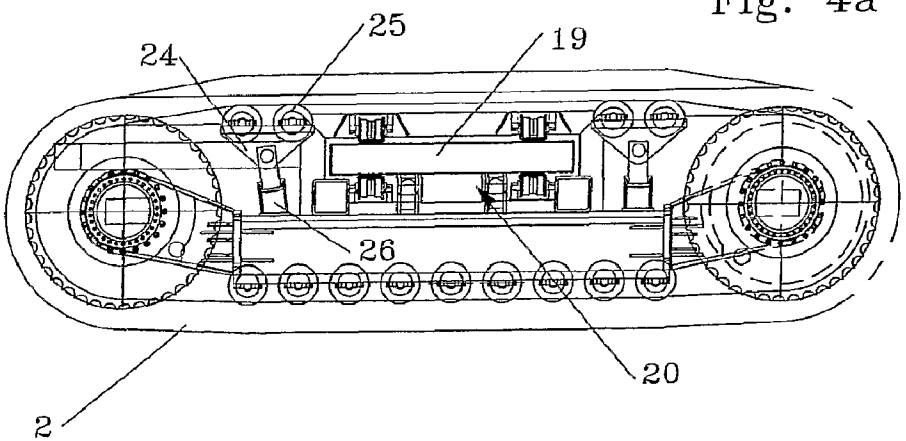
Figure 3A:
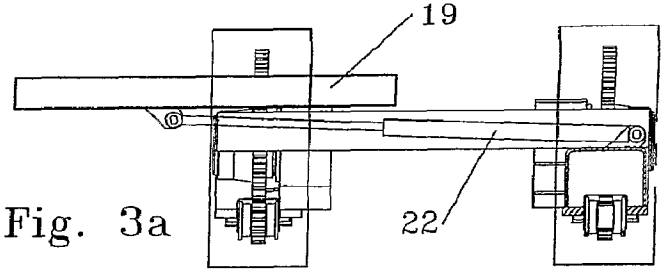
Figure 3B:
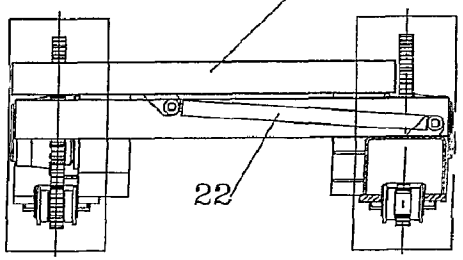
Figure 4B:
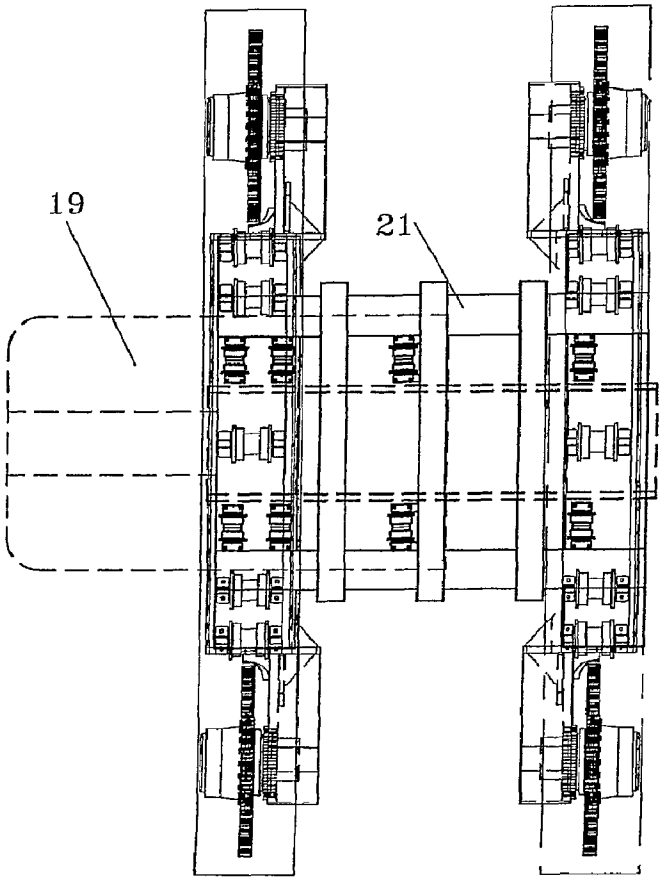
Figure 5C:
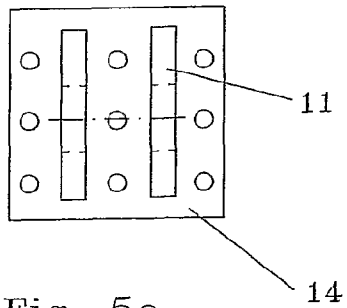
Figure 5A:
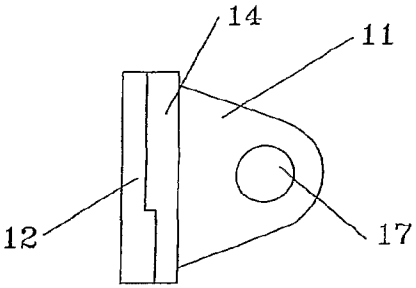
Figure 5D:
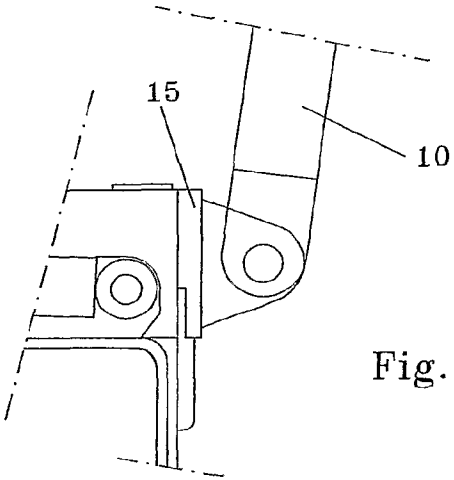
Figure 5B:
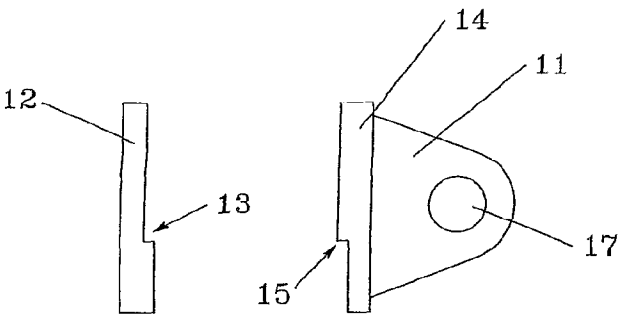

FIGS. 1*a* and 2*a* are the side view and front view of the machine respectively, in the version with front cab;

FIGS. 3*a* and 3*b* illustrate the plate that acts as counterweight, in the operational and retracted positions respectively;

FIGS. 4*a* and 4*b* illustrate the structure of the carriage and the crawler tracks with the plate acting as counterweight, seen from the side and from above respectively;

FIGS. 5*a* to 5*d* are four views of the system designed to couple the boom to the track-guide carriage.

In the annexed figures, the pipe-laying machine according to the invention comprises a tracked chassis indicated as 5, driven by a pair of tracks 2, to which an engine unit 3 and a control cab 4 are fitted at the rear and front ends respectively, or vice versa.

The central space thus remains free, and winches 6 and 7, fitted with metal cables 8 and 9 designed to support and move boom 10 of a crane and the associated load, are positioned in it.

This structure, which substantially consists of two tubular units at the upper end, is connected at the lower end to track chassis 5, via connectors 11.

Each of said connectors comprises a plate 12, which presents a ledge 13 on one side and is welded or otherwise attached to the structure of the machine, and a second plate 14 with a shape complementary to plate 12 (in other words also having a ledge 15 on its surface), to which a pair of wings 16, with a hole 17 for the insertion of a hinge pin, is welded.

The lower end of tubular element 10 is positioned between wings 16, and said element is retained in position by the pin inserted in hole 17.

The pins thus form a hinge around which, as a result of the action of winch 6, boom 10 can rotate along an axis parallel to the longitudinal axis of the machine, in order to lift and lay the pipes.

The advantage of this method of connecting the mobile boom is that it limits the width of the machine during transport, when the boom is removed, due to the possibility of removing plate 14 with projecting wings 16.

A pulley with a hook 18, from which the pipes are hung using suitable harnesses not illustrated in the figure, is fitted to the end of said boom 10. The second winch, shown as 15, allows lifting and laying of the pipes.

As already mentioned, the machines according to the prior art present the problem of low stability if no counterweight is fitted, or large size if counterweights are fitted.

To eliminate said problem, this invention uses a counterweight 19 consisting of a very thick metal plate (e.g. 20 to 40 cm), inserted in a seating 20 in the tracked chassis, on the opposite side of the machine to the side where the boom is attached, at a height between the lower portion and the upper portion of tracks.

To eliminate said problem, this invention uses a counterweight 19 consisting of a very thick metal plate (e.g. 20 to 40 cm), inserted in a seating 20 in the track-guide carriage, on the opposite side of the machine to the side where the boom is attached.

Said counterweight can slide in guides with rollers 21 and is subject to the action of means, such as hydraulic cylinders 22, electric motors or the like, which enable it to traverse and move from a rest position in which it retracts fully into the machine (FIG. 3*b*) to an operating position in which it projects from the contour of the vehicle (FIG. 3*a*).

The function of said counterweight is to counterbalance the moment created by the loads lifted on the opposite side of the machine and to prevent the risk of overturning, especially if, as often happens, the machine operates on slopes or uneven terrain.

The advantage of this system, as well as improving the stability of the vehicle by lowering its centre of gravity due to the particular position of the counterweight, is to make machines which are smaller than the present ones, even though they are fitted with means designed to counteract the tilting moment caused by the crane and its load.

Thus, due to the adoption of the counterweight and the new crane coupling system, the perfected pipe-laying machine can be transported on a trailer with no need for an escort, because its overall dimensions do not exceed those specified in the Highway Code.

A further improvement provided by the invention is that the tracks are mounted on four drive wheels (23).

This solution is very useful, firstly because these types of machine generally operate on very uneven terrain, e.g. near the edge of a trench, and this method guarantees better traction and better control of the vehicle by the operator, and secondly because the size of the machine is limited.

Four-wheel drive allows the use of much smaller reducers than would be needed to transmit power in the case of two-wheel drive, which would excessively increase the size of the machine.

Moreover, whereas in similar known machines the idle wheels keep the tracks taut, in the machine according to the invention specific tensioning devices are installed, consisting of rocker arms 24 fitted with pairs of rollers 25 and mounted on telescopic supports 26 (FIG. 4*a*) fixed to the carriage.

The result is a perfected pipe-laying machine which simultaneously presents the advantages of greater stability, smaller size, and easier operation. An expert in the field could devise various modifications and variations, all of which should be deemed to fall within the ambit of this invention, as defined in the annexed claims.

The invention claimed is:

1. Pipe-laying machine comprising a self-propelled tracked vehicle, said vehicle comprising a tracked chassis driven by tracks, having a lower portion and an upper portion, a crane fitted at one side of said tracked chassis and designed for lifting and laying pipes, a counterweight consisting of a plate made of a heavy material, which moves between a rest position in which it retracts fully into the vehicle and an operational position in which it projects from the vehicle on the opposite side to the crane, wherein said plate made of heavy material is positioned in a seating in the tracked chassis at a height between the lower and the upper portion of tracks, actuating means being provided for control the sliding movement of said plate, from said rest position to said operational position and vice versa.

2. Pipe-laying machine as claimed in claim 1, wherein said plate is an iron plate.

3. Pipe-laying machine as claimed in claim 2, wherein a crane boom consisting of tubular elements is hinged, at a base, to a vehicle chassis and it is connected, at a top, to a cable operated by a winch to vary the inclination of said crane boom, said machine being wherein connectors of said boom comprise a first plate fixed to a structure of the machine and a second plate to which pairs of projecting wings are welded, the tubular elements that constitute the crane boom being hinged to said wings, and said second plate being removably coupled to said first plate.

4. Pipe-laying machine as claimed in claim 2, wherein the tracks are mounted on four drive wheels.

5. Pipe-laying machine as claimed in claim 1, wherein said actuating means are one or more hydraulic cylinders.

6. Pipe-laying machine as claimed in claim 5, wherein a crane boom consisting of tubular elements is hinged, at a base, to a vehicle chassis and it is connected, at a top, to a cable operated by a winch to vary the inclination of said crane boom, said machine being wherein connectors of said boom comprise a first plate fixed to a structure of the machine and a second plate to which pairs of projecting wings are welded, the tubular elements that constitute the crane boom being hinged to said wings, and said second plate being removably coupled to said first plate.

7. Pipe-laying machine as claimed in claim 5, wherein the tracks are mounted on four drive wheels.

8. Pipe-laying machine as claimed in claim 1, further comprising an engine unit and cab each located at proper end of chassis, so as to leave a free space in a central area in which crane driving devices are installed.

9. Pipe-laying machine as claimed in claim 8, wherein a crane boom consisting of tubular elements is hinged, at a base, to a vehicle chassis and it is connected, at a top, to a cable operated by a winch to vary the inclination of said crane boom, said machine being wherein connectors of said boom comprise a first plate fixed to a structure of the machine and a second plate to which pairs of projecting wings are welded, the tubular elements that constitute the crane boom being hinged to said wings, and said second plate being removably coupled to said first plate.

10. Pipe-laying machine as claimed in claim 8, wherein the tracks are mounted on four drive wheels.

11. Pipe-laying machine as claimed in claim 1, wherein a crane boom consisting of tubular elements is hinged, at a base, to a vehicle chassis and it is connected, at a top, to a cable operated by a winch to vary the inclination of said crane boom, said machine connectors of said boom comprise a first plate fixed to a structure of the machine and a second plate to which pairs of projecting wings are welded, the tubular elements that constitute the crane boom being hinged to said wings, and said second plate being removably coupled to said first plate.

12. Pipe-laying machine as claimed in claim 11, wherein contact surfaces of said first and second plate have complementary shapes, to facilitate their exact mutual positioning.

13. Pipe-laying machine as claimed in claim 12, wherein the tracks are mounted on four drive wheels.

14. Pipe-laying machine as claimed in claim 11, wherein the tracks are mounted on four drive wheels.

15. Pipe-laying machine as claimed in claim 1, wherein the tracks are mounted on four drive wheels.

* * * * *